United States Patent [19]

Pine

[11] Patent Number: 4,601,513

[45] Date of Patent: Jul. 22, 1986

[54] ROCK-BLOCKING MECHANISM FOR ROCKING CHAIR

[75] Inventor: James J. Pine, Tupelo, Miss.

[73] Assignee: Action Industries, Inc., Tupelo, Miss.

[21] Appl. No.: 735,369

[22] Filed: May 17, 1985

[51] Int. Cl.[4] ..... A47C 3/02

[52] U.S. Cl. ..... 297/270; 297/85; 297/DIG. 7

[58] Field of Search ..... 297/270, 269, 85, 259, 297/DIG. 7

[56] References Cited

U.S. PATENT DOCUMENTS

| | | | |
|---|---|---|---|
| Re. 27,231 | 11/1971 | Fletcher | 297/259 |
| 2,746,519 | 5/1956 | Krikorian | 297/269 |
| 3,352,601 | 11/1967 | Cycowicz | 297/85 |
| 3,371,959 | 3/1968 | Gordin | 297/310 |
| 3,379,473 | 4/1968 | Mizelle | 297/270 |
| 3,637,255 | 1/1972 | Re | 297/85 |
| 3,730,585 | 5/1973 | Rogers, Jr. et al. | 297/85 |
| 3,747,973 | 7/1973 | Re | 297/269 X |
| 3,767,257 | 10/1973 | Rogers, Jr. et al. | 297/85 |
| 3,802,735 | 4/1974 | Re | 297/85 |
| 3,826,532 | 7/1974 | Caldemeyer | 297/270 |
| 3,869,170 | 3/1975 | James et al. | 297/270 |
| 3,912,327 | 10/1975 | Johnson | 297/270 X |
| 4,057,289 | 11/1977 | Jones | 297/270 X |
| 4,071,276 | 1/1978 | Cecil | 297/270 X |
| 4,128,273 | 10/1978 | Jones | 297/270 X |
| 4,154,475 | 5/1979 | Shoemaker et al. | 297/270 X |
| 4,179,157 | 12/1979 | Shoemaker et al. | 297/DIG. 7 |
| 4,319,780 | 3/1982 | Rogers, Jr. | 297/85 |

*Primary Examiner*—Francis K. Zugel

*Attorney, Agent, or Firm*—Cushman, Darby & Cushman

[57] ABSTRACT

In a motion chair which is also a platform rocker with an extensible, retractable ottoman, handled-operated rotation of the torque tube which extends transversely between the side linkages for coordinating thrusting and retraction of the left and right ends of the ottoman is relied upon for setting and releasing a rocker lock secured on the underside of the rocker cam subframe intermediate and, preferably medially of the side linkages. The rocker lock includes two struts respectively transverse axis-pivoted scissors-fashion to a fixed mounting link. Rollers may be provided on the free first ends of these struts and their opposite second ends are connected by means of further interpivoted links to the torque tube in such a manner that as the torque tube is rotated in one angular sense, the strut second ends are pulled up to lower the rollers into engagement with fixed cross members of the chair platform subframe. And as the torque tube is rotated in the opposite angular sense, the strut second ends are pushed down, thus raising the rollers and thus inactivating the rocker lock. The preferred arrangement of links is such that when the ottoman is thrust without reclining the chair back, the forward rock-preventing landing gear lands first, with further torque tube rotation serving to force the chair to rock a few degrees backwards on the platform before the rearward rock-preventing landing gear lands. The same rocker lock with minor modifications to torque tube attachment links can be used on chairs having different particular designs of side linkages.

22 Claims, 3 Drawing Figures

ROCK-BLOCKING MECHANISM FOR ROCKING CHAIR

BACKGROUND OF THE INVENTION

It has become conventional in the construction of motion chairs which are also platform rockers, to provide some type of locking mechanism that is active between the part of the chair that rocks and either the part of the chair that remains stationary or the floor. Typically, such locking mechanisms are in a non-active state, either disengaged or free to move, so long as the movable part of the chair remains upright, but to become activated as soon as the movable part has tilted, has reclined or the ottoman is raised to such a degree that the user can be expected to have his or her feet off the floor and no longer able to control rocking by a combination of foot pressure on the floor and forward rear pivoting motion of the upper body, i.e. just as a loss of control event is about to occur.

Several different types of locks have been developed. In one type, one or more crankable links are each provided at the free end with a roller or equivalent skid. This link is operatively connected to some part of the chair frame or motion chair mechanism which makes a characteristic relative movement at the time that the aforementioned loss of control event is about to occur in such a manner as to cause the free end of the lock link to engage the chair base or the floor and become a strut active in compression and/or in tension for bracing the rockable part of the chair against rocking. Thereafter, as the chair is brought back to an erect condition, and/or the ottoman is lowered to the point where the user can again exert control by pushing his or her feet on the floor, the aforementioned characteristic relative motion, occurring in reverse, or in an equivalent manner is used for withdrawing the free end of the link away from the chair base or floor, so that rocking is again possible. Perhaps due to some physical similarity of these locks, their function and/or manner of deployment and retraction, locks of this type often have become nicknamed "landing gear", after the like-named structures of aircraft.

Typically in a motion chair having a landing gear-type rocker lock when mounted forwardly of where the rocker cams run on the side rails of the base, mere engagement of the free end of the lock link with a touchdown pad on the base, or with the floor under or to the front of the chair will prevent forward rocking, but will not prevent rearward rocking. On some chairs this is sufficient, because the chair/occupant composite center of gravity shifts in such a way during its tilting, reclining and/or ottoman-elevating motion that the composite of the center of gravity of the use and rockable part of the chair is located forwardly of the rocker cam/rail engagement and rear rocking need not be protected against because it is so unlikely to occur. In other instances, use of a forwardly-located merely-engaged landing gear-type rocker lock is acceptable because some other type of rocker lock, e.g. one of the ratchet and releasable pawl-type is also provided and coordinately activated to prevent rearward rocking.

In cases where a forwardly-located landing gear-type rocker lock is provided and must serve to prevent both forward and rear locking, a trap is conventionally provided for the free end of the strut. As the chair is tilted, reclined and/or its ottoman is raised, the free end of the landing gear strut is pivoted into the trap, which is a claw-like or cage-like element mounted on the chair base. This element is shaped to secure the free end of the landing gear strut so that not only does the strut perform as a brace in compression to prevent forward locking, but it also performs as a tensile tie to prevent rearward rocking.

On other motion chairs, the landing gear-type rocker blocking mechanism provides its strut to the rear of where the rocker cams ride on the side rails, so that mere engagement with a touchdown pad is sufficient to prevent rearward rocking, but a cage, or some auxiliary rocker lock is required for preventing forward rocking.

In addition to landing-gear types of rocker locks, the prior art includes ones of the aforementioned ratchet and releasable pawl type, ones of the toggled links type, ones where a tubular slider mounted to the rockable part of the chair is constructed and arranged to releasably grip a fixed bar, and possibly other diverse types of locks.

Many conventional rocker locks are provided in duplicate as more or less integral parts of the left and right side linkages further complicating the design and installation of these already often baffling complex members and adding to the difficulty of manufacturing and mounting them. Further, such rocker locks often are fairly organic to the side linkages for which they were designed, so that design costs cannot be spread over a plurality of different side linkage designs so the benefit of long production runs sometimes cannot be achieved. Demand for the rocker locks depends on the demand for the particular design of side linkages of which they form a part.

Some advantages are to be gained from separating the rocker lock from the side linkages, e.g. so that the same rocker lock can be used on chairs having different designs of side linkages, and for achieving a locked condition which imparts a secure, stable feeling to the chair user in spite of the effects of mass production and wear on motion chair hardware geometry and fit.

Some conventional rocker locks which are separate from side linkages are installed intermediate the side linkages, e.g. near the longitudinal centerline of the chair. When such a rocker lock is laterally offset somewhat from the longitudinal centerline of the chair, often it is because a compromise was required between the desire to center the rocker lock and the need to prevent a user who is heavy or sits down hard on the chair from bottoming-out the springing means of the chair seat, on a part of the rocker lock. Stated another way, there has been a heretofore unfilled desire in the art to provide rocker lock that is independent of the motion chair side linkages, which, when activated, locks the chair against both forward and rear rocking, and which can be medially located on the chair without interfering with user comfort.

SUMMARY OF THE INVENTION

In a motion chair which is also a platform rocker with an extensible, retractable ottoman, handled-operated rotation of the torque tube which extends transversally between the side linkages for coordinating thrusting and retraction of the left and right ends of the ottoman is relied upon for setting and releasing a rocker lock secured on the underside of the rocker cam subframe intermediate and, preferably medially of the side linkages. The rocker lock includes two struts respectively transverse axis-pivoted scissors-fashion to a fixed mounting link. Rollers may be provided on the free first ends of these struts and their opposite second ends are connected by means of further interpivoted links to the torque tube in such a manner that as the torque tube is rotated in one angular sense, the strut second ends are pulled up to lower the rollers into engagement with fixed cross members of the chair platform subframe. And as the torque tube is rotated in the opposite angular sense, the strut second ends are pushed down, thus raising the rollers and thus inactivating the rocker lock. The preferred arrangement of links is such that when the ottoman is thrust without reclining the chair back, the forward rock-preventing landing gear lands first, with further torque tube rotation serving to force the chair to rock a few degrees backwards on the platform before the rearward rock-preventing landing gear lands. The same rocker lock with minor modifications to torque tube attachment links can be used on chairs having different particular designs of side linkages.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
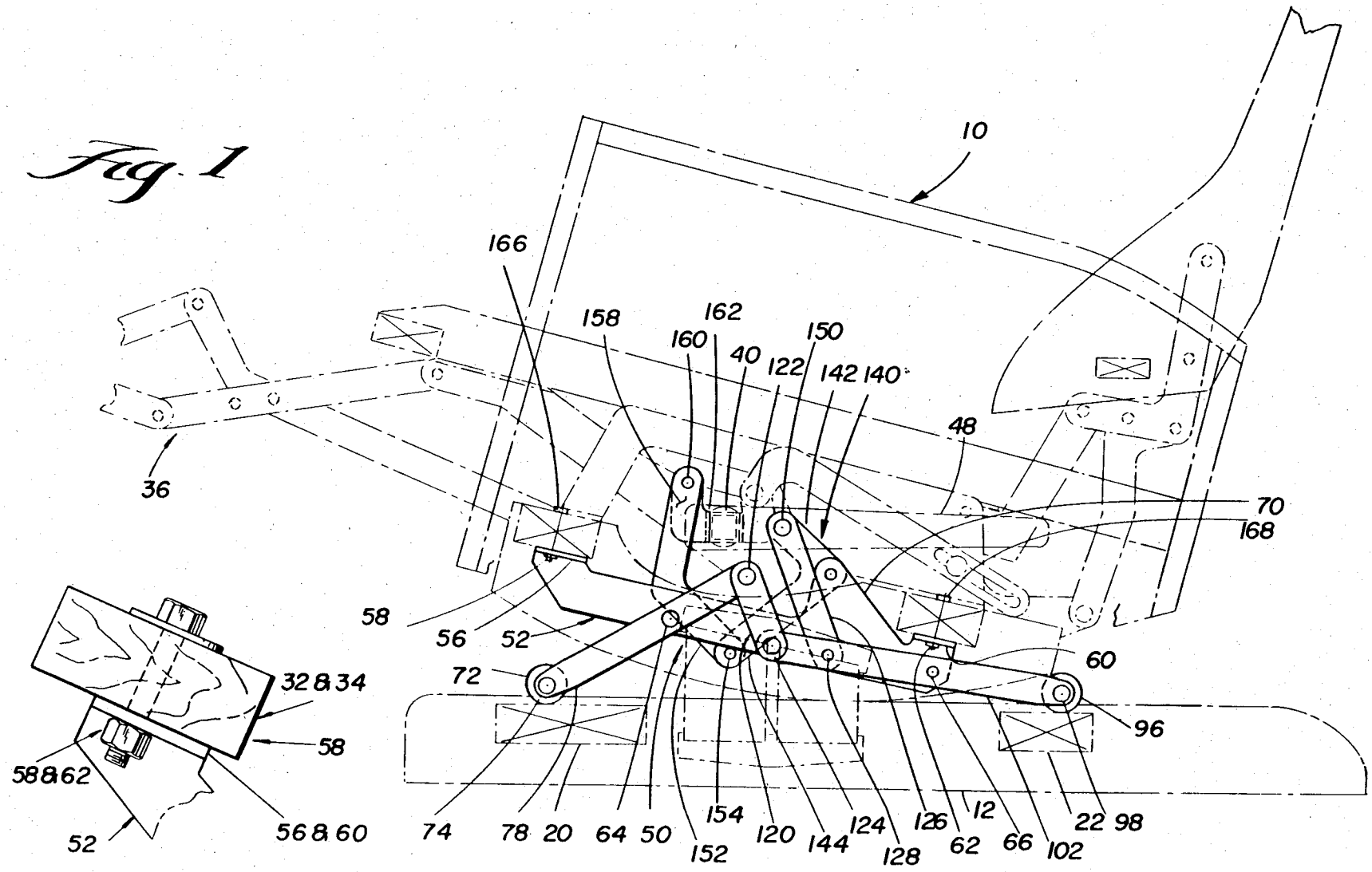
FIG. 1 is a fragmentary vertical longitudinal sectional view of a motion chair provided with a rocker lock embodying principles of the present invention.
Figure 2:
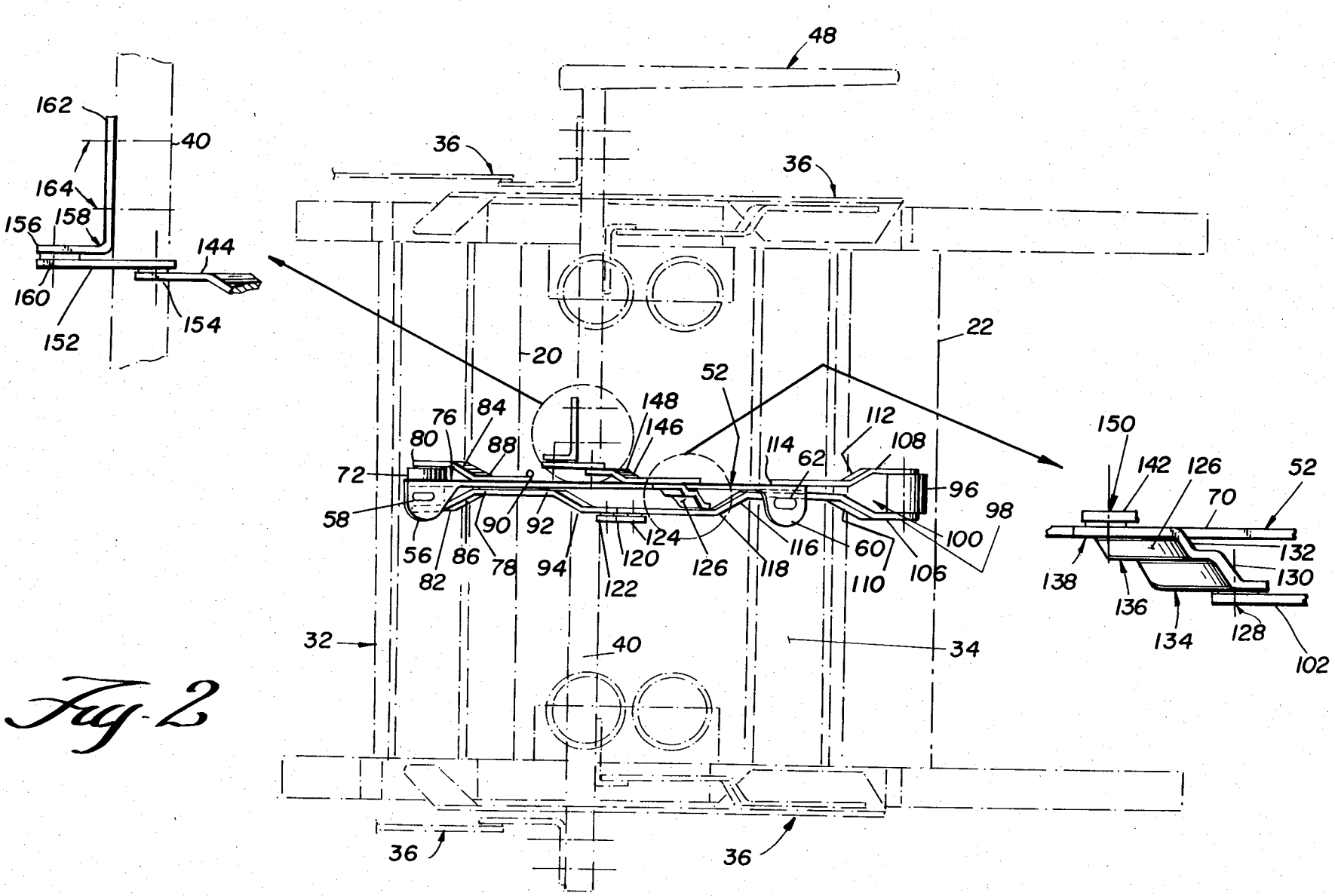
FIG. 2 is a fragmentary top plan view thereof.
Figure 3:
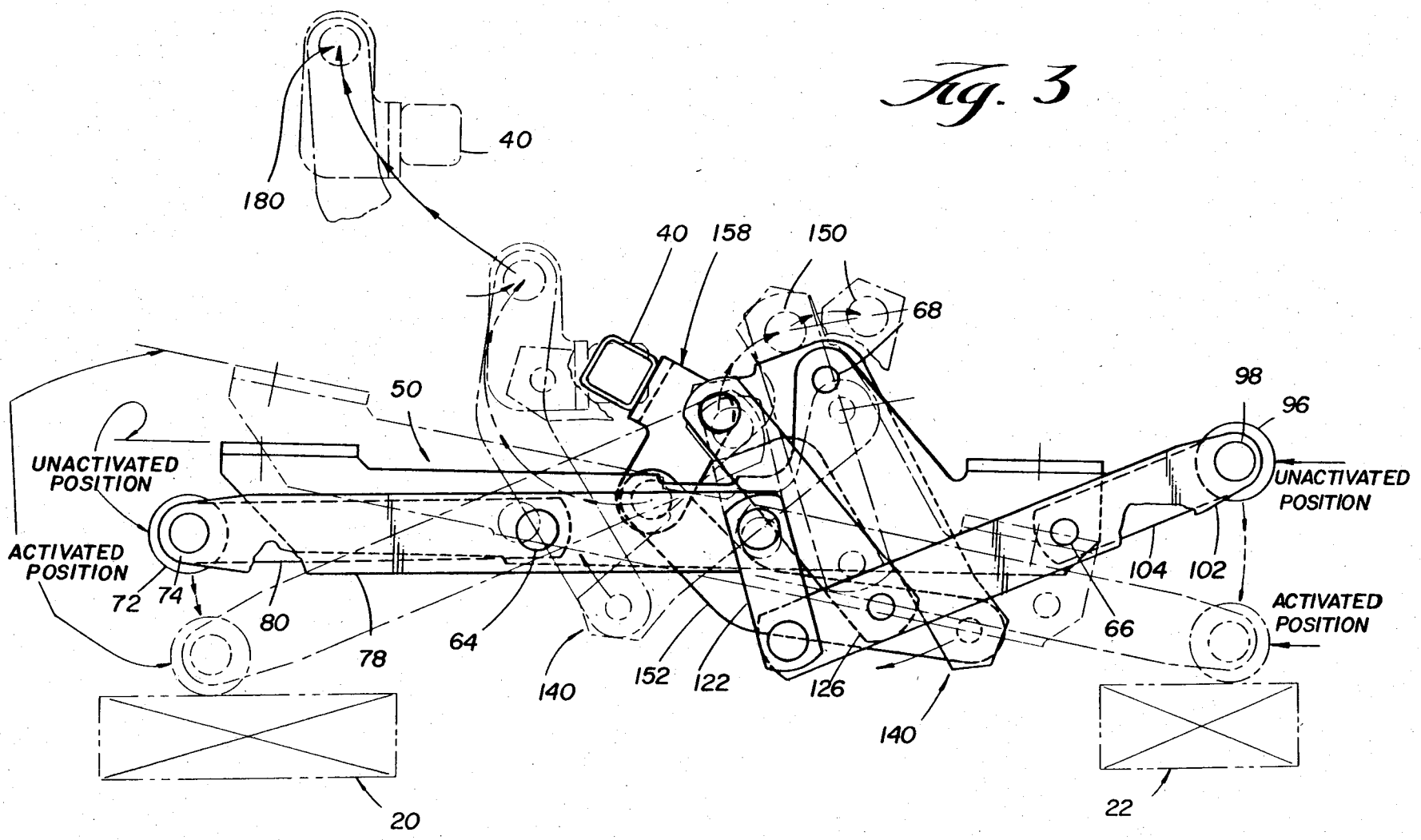
FIG. 3 is a transverse cross-sectional view of the torque tube and the handle and handle pivot link mounted thereto showing in solid lines the FIG. 1 position of this structure, and in dashed lines the extreme positions and locus of movement of this structure as the handle is rotated to its opposite extremes.

Platform rockers in which a rocker frame is rockably mounted on a platform base with the aid of counterbalancing springs and a handle-operated, lazy long-type side linkage mounted thrustable-retractable ottoman is provided, where the left and right side linkages also serve to mount the chair backrest and the chair seat frame on the rocker frame, and where the left and right side linkages are coordinately operated by a torque tube, i.e. a transverse shaft rotatably journalled in bearings provided in two corresponding links of the left and right side linkages and to one protruding outer end of which the operating handle is secured to extend radially therefrom are so well known in the art that it is believed unnecessary to provide one of ordinary skill in the art with an exhaustively complete representation of one in the drawings and description hereof. Interested readers are referred, e.g. to the U.S. Pat. No. 3,730,585, of Rogers et al issued May 1, 1973.

The conventional structure of such a chair 10 is represented in FIG. 1 by a base frame 12, e.g. made of wood so as to have mirror image left and right side members 14 providing floor-engaging feet 16 and upwardly-presented, horizontal, longitudinally extending left and right side rails 18 united by front and rear cross-members 20, 22 having upwardly presented surfaces 24. Typically, the base frame 12 is a fairly rigid, unitary assembly. The conventional structure is further represented in FIG. 1 by a rocker frame 26, also typically fabricated as a fairly rigid, unitary assembly made of wood, having left and right rocker cam members downwardly facing convexly arcuate cam surfaces 30 constructed and arranged to rockingly run on the rails 18, and front and rear cross-members 32, 34. Conventional counterbalancing spring assemblies mounted between the corresponding rocker frame and base frame side members at the left and right for holding the chair on its platform with a predetermined, null position are exemplified by the one shown at 35.

Just enough of a typical far side linkage 36 of which the near side linkage, not shown, is a mirror image counterpart is shown in FIG. 1 as to suggest to the reader that each mounts to the respective side of the rocker frame 26, e.g. on or near the rear cross-member 34 at 38, where the transversally extending transverse member, i.e. the torque tube 40 is journalled therein at 42 for rotation in both angular senses about its own longitudinal axis, and the so called lazy tong, parallelogram, four-bar linkages or the like 44 to which the ottoman (not shown) is conventionally mounted for being thrust and retracted as the rotary movement of the torque tube 40 is operatively transmitted at 46 to the ottoman thrusting/retracting linkages when the handle 48 mounted to an end of the torque tube 40 is rotated a sufficient amount in the respective angular sense.

Some conventional motion chairs are purely rocking chairs with thrustable/retractable ottomans. In others, the degree of uprightness of the chair back relative to the chair seat and arm frame can be altered by the chair occupant, e.g. by "pushing-off" from the chair arms and leaning back while seated in the chair.

The rocker locking mechanism 50 of the present invention is preferably constructed and arranged to be fully functionally used on either type of chair.

A fundamental unit of the rocker locking mechanism 50 is the mounting link 52. This link includes a longitudinally extending, main body 54 arranged in a vertical plane. At its top, adjacent its forward end, a portion of the blank of which the link 52 is formed is folded over so as to extend laterally, to the left or to the right, e.g. at a right angle to the plane of the main body 54 to provide an ear-like forward mounting flange 56. A hole bored through this flange 56 is fitted with a plug nut 58 press fit, adhered, spot welded and/or otherwise conventionally secured therein from below so as to effectively provide cooperative means for that flange.

Similarly at its top, adjacent its rear end, a portion of the blank of which the link 52 is formed is folded over so as to extend laterally, to the left or to the right, e.g. at a right angle to the plane of the main body 54 to provide an ear-like rear mounting flange 60. A hole bore through this flange 60 is fitted with a plug nut 62 press fit, adhered, spot welded and/or otherwise conventionally secured therein from below so as to effectively provide cooperative securement means for that flange.

Three horizontal, transverse axis pivot joints are shown provided on the main body 54, located respectively at 64 about one-third the distance there along from the forward end at a site that will come to be located below and about an inch forwardly of the torque tube when the rocker locking mechanism 50 is mounted to the chair frame; at 66 adjacent the rear end of the main body 54; and at 68 on a vertically upwardly extending ear 70 which places the pivot joint 68 approximately midway between the torque tube 40 and the rear cross member 34 of the rocker frame 26 and at about the same level as the torque tube 40.

The forward rocker lock is shown comprising a roller 72 rotatably journalled on a transverse axis horizontal axle 74 mounted in a forwardly opening yoke 76 provided by respectively bent portions of a front tilt link 78 and a front assist link 80. At the rear (base) of the yoke 76, the links 78, 80 are provided with shallow, obtuse angle Z-bends giving them oblique portions 82, 84 and longitudinally oriented rear portions 86, 88 which flank opposite lateral faces of the main body 54 of the mounting link 52. At 64, the portions 86, 88 of the links 78, 80 are pivotally mounted to the main body 54 the front assist link 80 ends here, at 90, but the front tilt link 78 is shown extending further longitudinally rearwardly, e.g. nearly another three inches, and in that portion being provided with another shallow, obtus angle Z-bend giving the link 78 an oblique portion 92 and a longitudinally oriented rear portion 94 that is at least approximately coplanar with the part of the yoke 76 formed at the forward end of the same link 78. The rear end of the front tilt link 78 is located about an inch forwardly of the pivot joint 68 on the vertical flange 70 of the main body 54.

Similarly, the rear rocker lock is shown comprising a roller 96 rotatably journalled on a transverse axis horizontal axle 98 mounted in a rearwardly opening yoke 100 provided by respectively bent portions of a rear tilt link 102 and a rear assist link 104. At the front (base) of the yoke 100, the links 102, 104 are provided with shallow, obtuse angle Z-bends giving them oblique portions 106, 108 and longitudinally oriented forward portions 110, 112 which flank opposite lateral faces of the main body 54 of the mounting link 52. At 66, the portions 110, 112 of the links 102, 104 are pivotally mounted to the main body 54. The rear assist link 104 ends here, at 114, but the rear tilt link 102 is shown extending further longitudinally forwardly, e.g. approximately another four inches, and in that portion being provided with another shallow, obtuse angle Z-bend giving the link 102 an oblique portion 116 and a longitudinally oriented forward portion 118 that is at least approximately coplanar with the part of the yoke 100 formed at the rear end of the same link 102. The forward end of the rear tilt link 102 is located about an inch and a half below and slightly to the rear of the rear end of the forward tilt link 78. Adjacent these ends, these two links are joined by a forwardly, upwardly sloped, generally vertically extending toggle link 120 which is pivotally connected adjacent its own upper end to the front tilt link 78 by a transversally horizontally extending pivot joint 122 and adjacent its own lower end to the rear tilt link 102 by a transversally horizontally extending pivot joint 124. In the preferred construction, the toggle link 120 is located laterally outwardly of the two link ends to which it is pivotally joined.

At a site located about two-thirds of the distance forwardly of the pivot joint 66 towards the pivot joint 124, a lift link 126 is pivotally connected adjacent its lower end, by a transversally extending horizontal axis pivot joint 128 to the forward portion 118 of the rear tilt link 102.

It should now be apparent that the basic activation/-deactivation of the lock mechanism 50, in which the front and rear landing gear comprising the respective forward and rear yoke-mounted rollers is effected by appropriately pulling-up and pushing-down on the lift link 126. The remaining links and pivot joints to be described are constructed and arranged for providing that pulling and pushing action when the legrest of the chair is thrust and retracted and/or the chair back is reclined and erected, while accommodating lost motion between the torque tube 40 and the lift link 126 lower pivot joint 128 as the chair is rocked with the back erect and the legrest stowed.

In the preferred construction, the lower end of the lift link 126 flanks the medial face of the forward portion of the rear tilt link 102, i.e. the opposite face from that flanked by the lower end of the toggle link 120.

The lift link 126 is shown provided with two successive shallow, obtuse angle Z-bends, so that its two oblique portions 130, 132 are oblique in the same angular sense and its three longitudinally oriented portions 134, 136, 138 are located progressively more medially of the lock mechanism 50. This permits the lift link 126 to move along side the vertical flange 70 of the main body of the mounting link 52 without engaging or interfering with that link, yet places the uppermost end portion 138 of the lift link 126 substantially in the same plane as the vertical flange 70. (In operation of the lock mechanism 50, the lift link upper end portion moves in an arc which curves in front of the vertical flange 70 to over top of that flange, generally spacedly following the contour of that flange 70.

A bell crank link of generally inverted L-shaped profile is shown provided at 140. This link 140 has a shorter leg 142 and a longer leg 144. At its crux, the link 140 is pivotally joined to the vertical flange 70 of the main body 54 by the pivot joint 68. In the preferred construction, the bell crank link 140 flanks the opposite face of the main body 54 from that flanked by the lift link 126 its upper shorter leg 142 projects forwardly from the joint 68, and its longer leg 144 rotates from being more vertically downwardly oriented when the lock mechanism 50 is fully retracted, to being more forwardly projecting when the lock mechanism 50 is fully activated. The longer leg 144 is shown provided near its outer end (i.e. its end furthest from the pivot joint 68) with a shallow, obtuse angle Z-bend that provides an oblique portion 146 and a longitudinally aligned end portion 148, e.g. located in a plane that is slightly beyond the plane of the side of the forward yoke provided by the front assist link 80.

The outer end of the short leg of the bell crank link 140 is shown pivotally connected to the upper end of the lift link 126 by a transversally extending horizontal axis pivot joint 150. And the outer end of the long leg of the bell crank link 140 is shown pivotally connected to the lower end of a pull link 152 by a transversally extending horizontal axis pivot joint 154. The upper end of the pull link 152 is shown pivotally connected to the forward end of the short vertical flange 156 of a handle pivot link 158 by a transversally extending horizontal axis pivot joint 160. The pull link 152 is shown being planar and banana-shaped (convex forwardly), in order to permit its upper end to pivot around the torque tube without the rear edge of the pull link engaging or interfering with the torque tube. The handle pivot link vertical flange 156 is generally L-shaped, with the joint 160 being provided at the outer end of its forwardly projecting leg. The upper (outer) end of the other leg of the handle pivot link is shown bent-over at a right angle to provide a torque tube mounting flange 162, which extends laterally, e.g. about two inches and is provided with a series of, e.g. two openings 164 through the thickness thereof to provide for securement of this flange to the torque tube 40 of the chair.

In constructing the parts of the chair 10, the front and rear cross members 32 and 34 of the rocker frame are pre-drilled vertically through the thickness thereof to provide lock mechanism mounting holes 166, 168 and the torque tube 40 is cross drilled at a series of corresponding sites therealong to provide lock mechanism mounting holes 170. In assembling the chair 10, the flanges 56, 60 are placed against the undersides of the cross members 32, 34 and bolts 172 are run down tight through the pre-drilled slotted holes 166, 168 or into the plug nuts 58, 60 and after the mounting flange 162 is abutted with the correct face of the torque tube 40, nut and bolt assemblies 174 are installed through aligned openings 164, 170 to secure the mounting flange 162 to the torque tube 40.

The angular extents, lengths, pivot locations, juxtapositions and other physical relationships of the parts may, for example, be as shown.

What is important is that when the occupant is using the chair to rock, with the chair back erect and the legrest/footrest/ottoman or like structure retracted so that the occupant can still control rocking by alternating foot pressure on the floor to the front of the base of the chair, the rollers at the "business" ends of the front and rear landing gears are retracted (elevated) sufficiently above the cross members 20, 22 of the base frame 12 as to freely permit as great a degree of rocking amplitude as the occupant wishes, limited only by roller engagement on the cross member 20 or on the cross member 22 only when the chair has been rocked forwardly or rearwardly by such an extreme amount that further rocking in the respective direction would put the occupant in danger of tipping over in the chair. In other words, when the person wants to rock, he or she can freely rock as much as he wants, within maximum limits of prudence established by the chair manufacturer.

What is further important, is that when the chair occupant begins to rotate the handle 48 in a sense to operate the side linkages 36 to raise/extend/thrust the footrest/legrest/ottoman, the connection of the lock mechanism 50 to the torque tube 40 at 174 causes the lock mechanism to begin to be activated progressively lowering the front landing gear at a faster rate, by a greater magnitude than the rear landing gear is being lowered, so that by the time the person's feet can no longer touch the floor, the front landing gear is sufficiently down to prevent the ottoman from engaging or being driven into the floor as it is extended, and then is lifting the front of the rocker frame thus forcing the rockable part of the chair to tilt rearwardly by a desirable amount. At this time, the more slowly less dramatically lowering rear landing gear lands on the rear cross member 22 in time to prevent the chair from overbalancing to the rear (i.e. in time to keep it from tipping over backwards), as more of the weight of the person's trunk is borne on the backrest due to the rearward tilting of the rockable part of the chair.

It is conceivable that the forward landing gear and/or the rear landing gear could be constructed and arranged to land on the floor instead of on a respective cross member 20 or 22, and/or that the preferred rollers be replaced by non-rollable skids, e.g. made of lubricous synthetic plastic material, but the construction shown is that which is presently preferred.

During rotation of the handle 48 in the angularly opposite direction the forced canting and deprivation of rockability which were progressively imposed as the ottoman was extended are progressively extinguished in a reversal of the order in which they were caused by operation of the lock mechanism 50.

When the occupant has thrust the ottoman and by rotating the ottoman-thrusting handle, likely without giving it a thought has set the lock 50 by causing the rotation of the torque tube to be translated into an upward pull on the lift link 126, pivoting the front and rear landing gear down, he or she may then lean back and/or push-off on the arms of the chair and, in a chair having a back that is tiltably mounted to the said linkages 36, cause the chair back to tilt back. It is conventional in the construction of motion chair mechanisms for such tilting to be accompanied by effectively accentuating the sensation of backward tilting by causing the act of tilting the backrest, e.g. acting through four bar linkages at both sides of the chair mechanism, to swing the seat and arm frame in such a manner that the front of the seat tilts upwards by a few degrees. By virtue of interconnection of the mechanism links, and of the handle to the seat and arm frame, this means that when in such chairs, it is usual for the torque tube to be translated upwardly along a short arc 180 relative to the rocker frame as the chair back is reclined. Accordingly, it is important in the design of the lock mechanism 50 that, if it is going to be mountable on a motion chair which has a thrustable ottoman and is both a platform rocking chair and a reclining chair, both that raising of the torque tube along the arc 180 not cause damage to the lock mechanism 50 or to the chair, and that the lock mechanism not interfere with such use of the chair. In the preferred construction of the lock mechanism of the invention, what these requirements translate to is that when the chair back is reclined, lifting the torque tube along the arc 180, that action must not cause any substantial further lifting of the lift link 126. As should be apparent from the drawings, the geometry of the preferred lock mechanism construction is such that when the ottoman is fully thrust, the upper end of the short leg of the bell crank link 140 is nearing the top of is arc about the pivot 68, so that the lift on the torque tube, in lifting the lifting link and thus somewhat further pivoting the bell crank link 140 simply carries the upper end of the lift link 126 rearwardly without substantially lifting the lift link 126 any further. This action is reversed in erecting the chair from a reclined state.

The rocker locking mechanism 50 preferably is fabricated using conventional techniques, using steel plate stampings, bored bent, riveted, pivotally pinned, provided with spacer washers, painted matte black and bolted to the rocker frame and torque tube. Preferably washer-like bushings for pivot joints and the rollers are made of a lubricous plastic material such as nylon, acetal resin or the like. In some instances, as should be apparent, the profiles of links of the rocker locking mechanism are dictated by the need for clearance as parts move past one another. In other instances what may look like arbitrarily placed notches in the profiles of parts are artifacts of arranging the patterns of the blanks of the links so that the greatest amount of them can be cut from the least amount of steel plate.

It should now be apparent that the rock-blocking mechanism for rocking chair as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A rock-blocking mechanism for a rocking chair having a forwardly/rearwardly rockable rocker frame to left and right sides of which are respectively mounted left and right side linkages interconnected by a transversally extending torque tube journalled in said side linkages for reversible angular rotation in one and opposite directions about its own longitudinal axis, respectively for extending and retracting an ottoman mounted to respective links of said left and right side linkages, said rock-blocking mechanism comprising:

a mounting link constructed and arranged to be mounted to said rocker frame at least approximately medially thereof, intermediate said left and right side linkages;

a front landing gear pivotally secured intermediate forward and rear ends thereof to said mounting link at a forward site on said mounting link, by first horizontally, transversally extending pivot joint means;

a rear landing gear pivotally secured intermediate forward and rear ends thereof to said mounting link at a rear site on said mounting link, by second horizontally, transversally extending pivot joint means;

toggle link means pivotally interconnecting said rear end of said front landing gear with said front end of said rear landing gear respectively by means of third and fourth horizontally, transversally extending pivot joint means, said toggle length means being sufficiently long as to permit said front and rear landing gear to be pivoted about said first and second pivot joint means between a first, raised condition in which the front end of the front landing gear and the rear end of the rear landing gear are disposed sufficiently above respective forward and rear datum planes at which, in use, respective upwardly facing fixed support surfaces can be expected to be located as to permit a substantial amount of forward and rear rocking of said rocker frame relative to said fixed support surfaces, and a second, lowered condition in which the front end of the front landing gear and the rear end of the rear landing gear are disposed in said forward and rear datum planes;

a generally vertically-oriented lift link having a lower end pivotally secured by fifth horizontally, transversally extending pivot joint means to one of said front and rear landing gears between said first and second horizontally, transversally extending pivot joint means so that said lift link may be lifted to lower said front and rear landing gear to said lowered condition and lowered to raise said front and rear landing gear to said raised condition;

a generally L-shaped bell crank link having first and second legs with respective inner ends joined at a crux;

a sixth horizontally, transversally extending pivot joint means pivotally joining said bell crank link to said mounting link intermediate the longitudinal extent of said mounting link;

a seventh horizontally, transversally extending pivot joint means pivotally joining said first leg of said bell crank link distally of said crux to said lift link distally of said lower end of said lift link;

a series of pivotally interconnected links constructed and arranged to be secured at one end thereof to said torque tube so as to wrap about said torque tube as said torque tube is rotated in one angular direction about its own longitudinal axis, and to unwrap from about said torque tube as said torque tube is thereafter rotated in the opposite angular direction about its own longitudinal axis;

an eighth horizontally, transversally extending pivot joint means pivotally said second leg of said bell crank link distally of said crux to an opposite end of said series of pivotally interconnected links;

said bell crank link being so constructed and arranged as to have said first leg thereof project at least generally forwardly and said second leg thereof project at least generally downwardly when said landing gear are disposed in said raised condition thereof, and to have said fist leg thereof project at least generally vertically upwardly when said landing gear are disposed in said lowered condition thereof;

said series of pivotally interconnected links being constructed and arranged to rotatably pull said second leg of said bell crank link, by means of said eighth pivot joint means, from projecting at least generally vertically downwardly to projecting at least generally longitudinally forwardly as said torque tube is rotated in said one angular sense and to rotatably push said second leg of said bell crank link, by means of said eighth pivot joint means, from projecting at least generally longitudinally forwardly to projecting at least generally vertically downwardly as said torque tube is rotated in aid opposite angular sense.

2. The rock-blocking mechanism of claim 1, wherein:

said forward landing gear comprises a front assist link arranged beside a front tilt link, these links being complementarily configured adjacent respective forward ends thereof to define a yoke journalling a front landing gear roller for rotation about a horizontally, transversally extending axis to provide said front end of said front landing gear;

both said front assist link and said front tilt link being pivotally joined to said mounting link by said first pivot joint means; and at least said front tilt link being pivotally joined to said toggle link by said third pivot joint means.

3. The rock-blocking mechanism of claim 1, wherein:

said rear landing gear comprises a rear assist link arranged beside a rear tilt link, these links being complementarily configured adjacent respective rear ends thereof to define a yoke journalling a rear landing gear roller for rotation about a horizontally, transversally extending axis to provide said rear end of said rear landing gear;

both said rear assist link and said rear tilt link being pivotally joined to said mounting link by said second pivot joint means; and at least said rear tilt link being pivotally joined to said toggle link by said fourth pivot joint means.

4. The rock-blocking mechanism of claim 1, wherein:

said forward landing gear comprises a front assist link arranged beside a front tilt link, these links being complementarily configured adjacent respective forward ends thereof to define a yoke journalling a front landing gear roller for rotation about a horizontally, transversally extending axis to provide said front end of said front landing gear;

both said front assist link and said front tilt link being pivotally joined to said mounting link by said first pivot joint means; and at least said front tilt link being pivotally joined to said toggle link by said third pivot joint means; and said rear landing gear comprises a rear assist link arranged beside a rear tilt link, these links being complementarily configured adjacent respective rear ends thereof to define a yoke journalling a rear landing gear roller for rotation about a horizontally, transversally extending axis to provide said rear end of said rear landing gear;

both said rear assist link and said rear tilt link being pivotally joined to said mounting link by said second pivot joint means; and at least said rear tilt link being pivotally joined to said toggle link by said fourth pivot joint means.

5. The rock-blocking mechanism of claim 4, wherein:

said mounting link comprises a longitudinally elongated, vertically-oriented plate-like body having means defining a bent-over, generally horizontally-oriented forward mounting flange provided thereon near a forward end thereof, this forward mounting flange being constructed and arranged to be mounted to a front cross-member of said rocker frame, and means defining a horizontally-oriented rear mounting flange provided thereon near a rear end thereof, this rear mounting flange being constructed and arranged to be mounted to a rear cross-member of said rocker frame, for thereby securing said rock-blocking mechanism to said rocker frame.

6. The rock-blocking mechanism of claim 5, wherein:

said series of pivotally interconnected links is constituted by:

(a) a handle pivot link having a mounting flange constructed and arranged to be bolted to said torque tube and a generally vertically oriented, longitudinally extending plate-like body having a ninth horizontally, transversally extending pivot joint means provided thereon distally of said mounting flange; and (b) a forwardly convexly arcuate, generally vertically oriented, vertically extending pull link being pivotally secured at a lower end thereof to said second leg of said bell crank link by said eighth pivot joint means and being pivotally secured at an upper end thereof to said body of said handle pivot link by said ninth pivot joint means.

7. The rock-blocking mechanism of claim 1, wherein:

said mounting link comprises a longitudinally elongated, vertically-oriented plate-like body having means defining a bent-over, generally horizontally-oriented forward mounting flange provided thereon near a forward end thereof, this forward mounting flange being constructed and arranged to be mounted to a front cross-member of said rocker frame, and means defining a horizontally-oriented rear mounting flange provided thereon near a rear end thereof, this rear mounting flange being constructed and arranged to be mounted to a rear cross-member of said rocker frame, for thereby securing said rock-blocking mechanism to said rocker frame.

8. The rock-blocking mechanism of claim 7, wherein:

said series of pivotally interconnected links is constituted by:

(a) a handle pivot link having a mounting flange constructed and arranged to be bolted to said torque tube and a generally vertically oriented, longitudinally extending plate-like body having a ninth horizontally, transversally extending pivot joint means provided thereon distally of said mounting flange; and (b) a forwardly convexly arcuate, generally vertically oriented, vertically extending pull link being pivotally secured at a lower end thereof to said second leg of said bell crank link by said eighth pivot joint means and being pivotally secured at an upper end thereof to said body of said handle pivot link by said ninth pivot joint means.

9. The rock-blocking mechanism of claim 1, wherein:

said first and third pivot joint means are so located relative to the length of said front landing gear, and said second and fourth pivot joint means are so located relative to the length of said rear landing gear, that as said landing gear is being lowered from said raised condition thereof, said front end of said front landing gear reaches said forward datum plane before said rear end of said rear landing gear reaches said rear datum plane, so that further lowering of said landing gear to said lowered condition thereof must be accomplished, in part, by forced rearward tilting of the rocker frame.

10. A rocking chair, comprising:

a forwardly, rearwardly rockable rocker frame to left and right sides of which are respectively mounted left and right side linkages interconnected by a transversally extending torque tube journalled in said side linkages for reversible angular rotation in one and opposite directions about its own longitudinal axis, respectively for extending and retracting an ottoman mounted to respective links of said left and right side linkages;

a rocker blocking mechanism for preventing rocking of said rockable rocker frame when said ottoman is sufficiently thrust as to prevent an occupant of the chair from controlling forward/rear balance of the rocker frame by means of foot pressure combined with upper body movement, said rocker blocking mechanism comprising:

a mounting link constructed and arranged to be mounted to said rocker frame at least approximately medially thereof, intermediate said left and right side linkages;

a front landing gear pivotally secured intermediate forward and rear ends thereof to said mounting link at a forward site on said mounting link, by first horizontally, transversally extending pivot joint means;

a rear landing gear pivotally secured intermediate forward and rear ends thereof to said mounting link at a rear site on said mounting link, by second horizontally, transversally extending pivot joint means;

toggle link means pivotally interconnecting said rear end of said front landing gear with said front end of said rear landing gear respectively by means of third and fourth horizontally, transversally extending pivot joint means, said toggle length means being sufficiently long as to permit said front and rear landing gear to be pivoted about said first and second pivot joint means between a first, raised condition in which the front end of the front landing gear and the rear end of the rear landing gear are disposed sufficiently above respective forward and rear datum planes at which, in use, respective upwardly facing fixed support surfaces can be expected to be located as to permit a substantial amount of forward and rear rocking of said rocker frame relative to said fixed support surfaces, and a second, lowered condition in which the front end of the front landing gear and the rear end of the rear landing gear are disposed in said forward and rear datum planes;

a generally vertically-oriented lift link having a lower end pivotally secured by fifth horizontally, transversally extending pivot joint means to one of said front and rear landing gears between said first and second horizontally, transversally extending pivot joint means so that said lift link may be lifted to lower said front and rear landing gear to said lowered condition and lowered to raise said front and rear landing gear to said raised condition;

a generally L-shaped bell crank link having first and second legs with respective inner ends joined at a crux;

a sixth horizontally, transversally extending pivot joint means pivotally joining said bell crank link to said mounting link intermediate the longitudinal extent of said mounting link;

a seventh horizontally, transversally extending pivot joint means pivotally joining said first leg of said bell crank link distally of said crux to said lift link distally of said lower end of said lift link;

a series of pivotally interconnected links constructed and arranged to be secured at one end thereof to said torque tube so as to wrap about said torque tube as said torque tube is rotated in one angular direction about its own longitudinal axis; and to unwrap from about said torque tube as said torque tube is thereafter rotated in the opposite angular direction about its own longitudinal axis;

an eighth horizontally, transversally extending pivot joint means pivotally said second leg of said bell crank link distally of said crux to an opposite end of said series of pivotally interconnected links;

said bell crank link being so constructed and arranged as to have said firs leg thereof project at least generally forwardly and said second leg thereof project at least generally downwardly when said landing gear are disposed in said raised condition thereof, and to have said fist leg thereof project at least generally vertically upwardly when said landing gear are disposed in said lowered condition thereof;

said series of pivotally interconnected links being constructed and arranged to rotatably pull said second leg of said bell crank link, by means of said eighth pivot joint means, from projecting at least generally vertically downwardly to projecting at least generally longitudinally forwardly as said torque tube is rotated in said one angular sense and to rotatably push said second leg of said bell crank link, by means of said eighth pivot joint means, from projecting at least generally longitudinally forwardly to projecting at least generally vertically downwardly as said torque tube is rotated in said opposite angular sense.

11. The rocking chair of claim 10, wherein:

said forward landing gear comprises a front assist link arranged beside a front tilt link, these links being complementarily configured adjacent respective forward ends thereof to define a yoke journalling a front landing gear roller for rotation about a horizontally, transversally extending axis to provide said front end of said front landing gear;

both said front assist link and said front tilt link being pivotally joined to said mounting link by said first pivot joint means; and at least said front tilt link being pivotally joined to said toggle link by said third pivot joint means.

12. The rocking chair of claim 10, wherein:

said rear landing gear comprises a rear assist link arranged beside a rear tilt link, these links being complementarily configured adjacent respective rear ends thereof to define a yoke journalling a rear landing gear roller for rotation about a horizontally, transversally extending axis to provide said rear end of said rear landing gear;

both said rear assist link and said rear tilt link being pivotally joined to said mounting link by said second pivot joint means; and at least said rear tilt link being pivotally joined to said toggle link by said fourth pivot joint means.

13. The rocking chair of claim 10, wherein:

said forward landing gear comprises a front assist link arranged beside a front tilt link, these links being complementarily configured adjacent respective forward ends thereof to define a yoke journalling a front landing gear roller for rotation about a horizontally, transversally extending axis to provide said front end of said front landing gear;

both said front assist link and said front tilt link being pivotally joined to said mounting link by said first pivot joint means; and at least said front tilt link being pivotally joined to said toggle link by said third pivot joint means; and said rear landing gear comprises a rear assist link arranged beside a rear tilt link, these links being complementarily configured adjacent respective rear ends thereof to define a yoke journalling a rear landing gear roller for rotation about a horizontally, transversally extending axis to provide said rear end of said rear landing gear;

both said rear assist link and said rear tilt link being pivotally joined to said mounting link by said second pivot joint means; and at least said rear tilt link being pivotally joined to said toggle link by said fourth pivot joint means.

14. The rocking chair of claim 13, wherein:

said mounting link comprises a longitudinally elongated, vertically-oriented plate-like body having means defining a bent-over, generally horizontally-oriented forward mounting flange provided thereon near a forward end thereof, this forward mounting flange being constructed and arranged to be mounted to a front cross-member of said rocker frame, and means defining a horizontally-oriented rear mounting flange provided thereon near a rear end thereof, this rear mounting flange being constructed and arranged to be mounted to a rear cross-member of said rocker frame, for thereby securing said rock-blocking mechanism to said rocker frame.

15. The rocking chair of claim 14, wherein:

said series of pivotally interconnected links is constituted by:

(a) a handle pivot link having a mounting flange constructed and arranged to be bolted to said torque tube and a generally vertically oriented, longitudinally extending plate-like body having a ninth horizontally, transversally extending pivot joint means provided thereon distally of said mounting flange; and (b) a forwardly convexly arcuate, generally vertically oriented, vertically extending pull link being pivotally secured at a lower end thereof to said second leg of said bell crank link by said eighth pivot joint means and being pivotally secured at an upper end thereof to said body of said handle pivot link by said ninth pivot joint means.

16. The rocking chair of claim 10, wherein:

said mounting link comprises a longitudinally elongated, vertically-oriented plate-like body having means defining a bent-over, generally horizontally-oriented forward mounting flange provided thereon near a forward end thereof, this forward mounting flange being constructed and arranged to be mounted to a front cross-member of said rocker frame, and means defining a horizontally-oriented rear mounting flange provided thereon near a rear end thereof, this rear mounting flange being constructed and arranged to be mounted to a rear cross-member of said rocker frame, for thereby securing said rock-blocking mechanism to said rocker frame.

17. The rocking chair of claim 16, wherein:

said series of pivotally interconnected links is constituted by:

(a) a handle pivot link having a mounting flange constructed and arranged to be bolted to said torque tube and a generally vertically oriented, longitudinally extending plate-like body having a ninth horizontally, transversally extending pivot joint means provided thereon distally of said mounting flange; and (b) a forwardly convexly arcuate, generally vertically oriented, vertically extending pull link being pivotally secured at a lower end thereof to said second leg of said bell crank link by said eighth pivot joint means and being pivotally secured at an upper end thereof to said body of said handle pivot link by said ninth pivot joint means.

18. The rocking chair of claim 10, wherein:

said first and third pivot joint means are so located relative to the length of said front landing gear, and said second and fourth pivot joint means are so located relative to the length of said rear landing gear, that as said landing gear is being lowered from said raised condition thereof, said front end of said front landing gear reaches said forward datum plane before said rear end of said rear landing gear reaches said rear datum plane, so that further lowering of said landing gear to said lowered condition thereof must be accomplished, in part, by forced rearward tilting of the rocker frame.

19. The rocking chair of claim 18, further comprising:

a base frame constructed and arranged to be supported on a floor;

means providing left and right longitudinally extending, upwardly facing horizontal rails on said base frame, and front and rear cross members extending transversally between and interconnecting said rail-providing means;

said rocker frame including left and right rocker cams constructed and arranged to rockably run respectively on said left and right rails of said base frame;

left and right counterbalancing spring means securing said rocker frame on said base frame for forward and rear rocking thereon;

said forward and rear datum planes being disposed to coincide with upwardly presented surfaces of said front and rear cross members of said base frame.

20. The rocking chair of claim 19, wherein:

said forward landing gear comprises a front assist link arranged beside a front tilt link, these links being complementarily configured adjacent respective forward ends thereof to define a yoke journalling a front landing gear roller for rotation about a horizontally, transversally extending axis to provide said front end of said front landing gear;

both said front assist link and said front tilt link being pivotally joined to said mounting link by said first pivot joint means; and at least said front tilt link being pivotally joined to said toggle link by said third pivot joint means; and said rear landing gear comprises a rear assist link arranged beside a rear tilt link, these links being complementarily configured adjacent respective rear ends thereof to define a yoke journalling a rear landing gear roller for rotation about a horizontally, transversally extending axis to provide said rear end of said rear landing gear;

both said rear assist link and said rear tilt link being pivotally joined to said mounting link by said second pivot joint means; and at least said rear tilt link being pivotally joined to said toggle link by said fourth pivot joint means.

21. The rocking chair of claim 20, wherein:

said mounting link comprises a longitudinally elongated, vertically-oriented plate-like body having means defining a bent-over, generally horizontally-oriented forward mounting flange provided thereon near a forward end thereof, this forward mounting flange being constructed and arranged to be mounted to a front cross-member of said rocker frame, and means defining a horizontally-oriented rear mounting flange provided thereon near a rear end thereof, this rear mounting flange being constructed and arranged to be mounted to a rear cross-member of said rocker frame, for thereby securing said rock-blocking mechanism to said rocker frame.

22. The rocking chair of claim 21, wherein:

said series of pivotally interconnected links is constituted by:

(a) a handle pivot link having a mounting flange constructed and arranged to be bolted to said torque tube and a generally vertically oriented, longitudinally extending plate-like body having a ninth horizontally, transversally extending pivot joint means provided thereon distally of said mounting flange; and (b) a forwardly convexly arcuate, generally vertically oriented, vertically extending pull link being pivotally secured at a lower end thereof to said second leg of said bell crank link by said eighth pivot joint means and being pivotally secured at an upper end thereof to said body of said handle pivot link by said ninth pivot joint means.

* * * * *